US007916096B2

(12) United States Patent
Pawlak

(10) Patent No.: US 7,916,096 B2
(45) Date of Patent: Mar. 29, 2011

(54) COMMUNICATION SYSTEM HAVING CONFIGURABLE 3-D ANTENNA GRID AND METHOD FOR CONFIGURING THE COMMUNICATION SYSTEM

(75) Inventor: Andrzej M. Pawlak, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 938 days.

(21) Appl. No.: 11/766,235

(22) Filed: Jun. 21, 2007

(65) Prior Publication Data

US 2008/0316127 A1 Dec. 25, 2008

(51) Int. Cl.
*H01Q 3/24* (2006.01)

(52) U.S. Cl. ..... 343/876; 343/724

(58) Field of Classification Search ..... 343/893, 343/876, 724

See application file for complete search history.

(56) References Cited

U.S. PATENT DOCUMENTS

| | | | | |
|---|---|---|---|---|
| 5,986,612 | A | 11/1999 | Nagy | |
| 6,031,500 | A | 2/2000 | Nagy et al. | |
| 6,118,410 | A | 9/2000 | Nagy | |
| 6,266,023 | B1 | 7/2001 | Nagy et al. | |
| 6,714,771 | B1 | 3/2004 | Nagy et al. | |
| 6,950,629 | B2 | 9/2005 | Nagy | |
| 2005/0153658 | A1 | 7/2005 | Nagy | |
| 2005/0179614 | A1 | 8/2005 | Nagy | |
| 2005/0219142 | A1 | 10/2005 | Nagy | |
| 2006/0187051 | A1 * | 8/2006 | Wu et al. | 340/572.7 |
| 2006/0192721 | A1 * | 8/2006 | Goldberg | 343/834 |
| 2006/0240882 | A1 | 10/2006 | Nagy et al. | |
| 2007/0115192 | A1 * | 5/2007 | Brandwein, Jr. | 343/713 |

OTHER PUBLICATIONS

International Search Report for PCT Application No. PCT/US2008/0071080.

* cited by examiner

*Primary Examiner* — HoangAnh T Le
(74) *Attorney, Agent, or Firm* — J. Gordon Lewis

(57) ABSTRACT

A system and a method for configuring a communication system are provided. The communication system has an antenna system with a 3-D antenna grid. The configurable 3-D antenna grid has a plurality of antenna elements operably coupled to a plurality of switching elements. The method includes selecting a first 3-D antenna configuration associated with the configurable 3-D antenna grid from a plurality of antenna configurations. The method further includes controlling a memory device to output first data corresponding to the first 3-D antenna configuration. The method further includes closing selected ones of the plurality of switching elements to obtain the first 3-D antenna configuration in the configurable 3-D antenna grid in response to the first data. The first 3-D antenna configuration is one of the plurality of antenna configurations wherein at least a portion of the plurality of antenna elements are electrically coupled together.

9 Claims, 5 Drawing Sheets

COMMUNICATION SYSTEM HAVING CONFIGURABLE 3-D ANTENNA GRID AND METHOD FOR CONFIGURING THE COMMUNICATION SYSTEM

BACKGROUND

Communication systems have been developed to receive RF signals. However, the communication systems have not utilized a configurable 3-D antenna grid that allows improved reception of RF signals.

The inventor herein has recognized a need for an improved communication system that utilizes a configurable 3-D antenna grid that allows for improved reception of RF signals.

SUMMARY OF THE INVENTION

An antenna system in accordance with an exemplary embodiment is provided. The antenna system includes a configurable 3-D antenna grid having a plurality of antenna elements operably coupled to a plurality of switching elements. The antenna system further includes a switch controller operably coupled to the plurality of switching elements. The switch controller is configured to close selected ones of the plurality of switching elements to obtain a first 3-D antenna configuration in the configurable 3-D antenna grid. The first 3-D antenna configuration has at least a portion of the plurality of antenna elements electrically coupled together.

A communication system in accordance with another exemplary embodiment is provided. The communication system includes an antenna system having a configurable 3-D antenna, grid and a switch controller. The configurable 3-D antenna grid has a plurality of antenna elements operably coupled to a plurality of switching elements. The switch controller is operably coupled to the plurality of switching elements. The communication system further includes a memory device operably coupled to the switch controller. The memory device is configured to store data representing a plurality of antenna configurations. The communication system farther includes a processor operably communicating with the switch controller and the memory device. The processor is configured to generate a signal to induce the memory device to send first data corresponding to a first 3-D antenna configuration to the switch controller. The switch controller is configured to close selected ones of the plurality of switching elements to obtain the first 3-D antenna configuration in the configurable 3-D antenna grid in response to the first data. The first 3-D antenna configuration is one of the plurality of antenna, configurations wherein at least a portion of the plurality of antenna elements are electrically coupled together.

A method for configuring a communication system in accordance with another exemplary embodiment is provided. The communication system has an antenna system with a 3-D antenna grid. The configurable 3-D antenna grid has a plurality of antenna elements operably coupled to a plurality of switching elements. The method includes selecting a first 3-D antenna configuration associated with the configurable 3-D antenna grid from a plurality of antenna configurations. The method further includes controlling a memory device to output first data corresponding to the first 3-D antenna configuration. The method further includes closing selected ones of the plurality of switching elements to obtain the first 3-D antenna configuration in the configurable 3-D antenna grid in response to the first data. The first 3-D antenna configuration is one of the plurality of antenna configurations wherein at least a portion of the plurality of antenna elements are electrically coupled together.

BRIEF DESCRIPTION OF THE DRAWINGS

FIG. 13 is a schematic of an exemplary cone-shaped 3-D antenna grid; and

DESCRIPTION OF EXEMPLARY EMBODIMENTS

Figure 1:
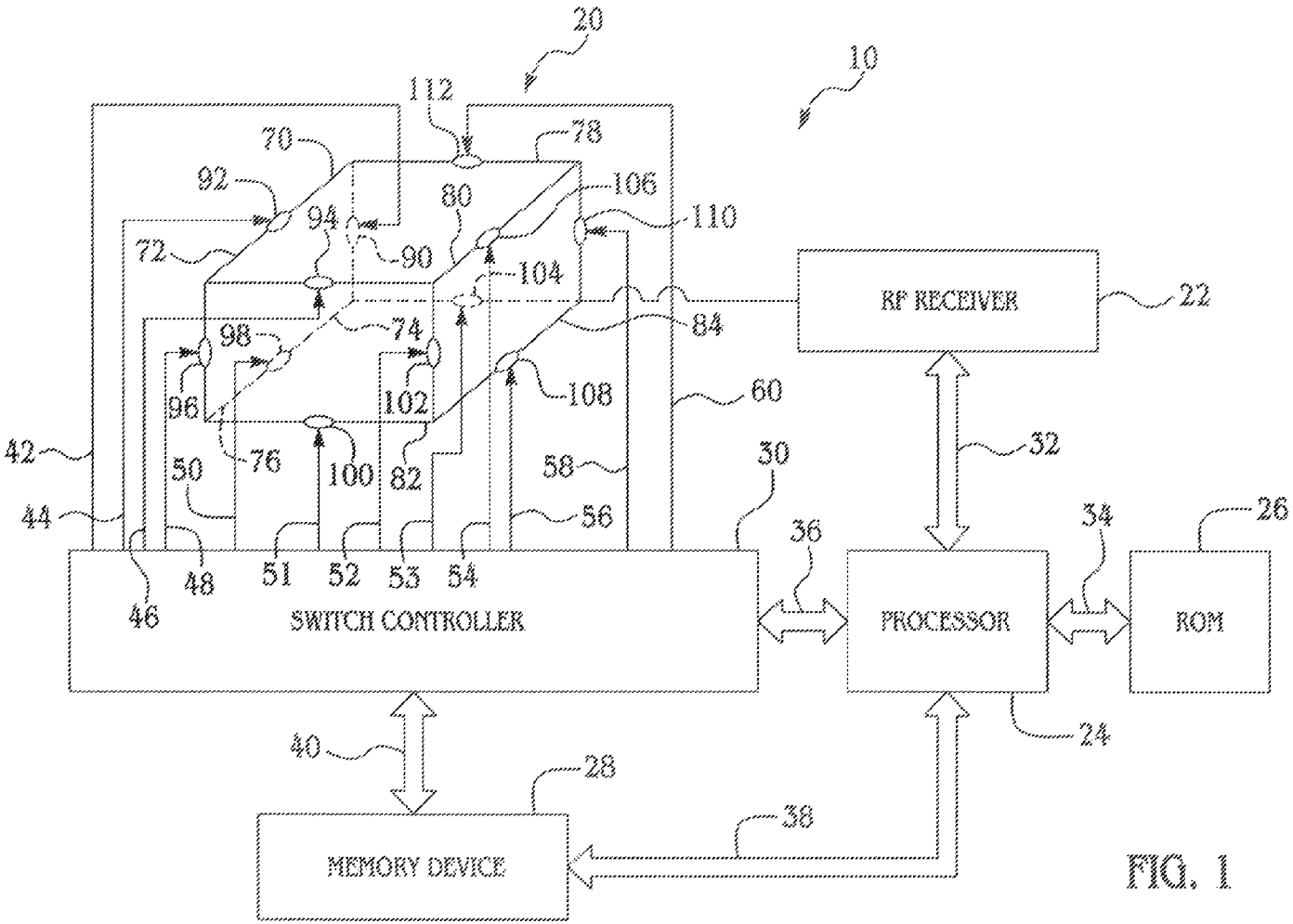
FIG. 1 is a schematic of a communication system having an antenna system with a configurable 3-D antenna grid in accordance with an exemplary embodiment.

Referring to FIG. 1, a communication system 10 in accordance with an exemplary embodiment is illustrated. The communication system 10 includes a configurable 3-D antenna grid 20, an RF receiver 22, a processor 24, a read-only memory (ROM) 26, a memory device 28, a switch controller 30, communication buses 32, 34, 36, 38, 40, and control lines 42, 44, 46, 48, 50, 51, 52, 53, 54, 56, 53 and 60.

The configurable 3-D antenna grid 20 has antenna elements 70, 72, 74, 76, 78, 80, 82 and 84 and switching elements 90, 92, 94, 96, 93, 100, 102, 104, 106, 108, 110 and 112. Those skilled in the art will appreciate that the antenna elements and the switching elements van be arranged in patterns other than the exemplary pattern depicted in FIG. 1. The antenna elements 70, 72, 74, 76, 78, 80, 82 and 84 can be implemented by wires or other conductors, including conductive traces for example. In one exemplary embodiment, the switching elements 90-112 are implemented using bipolar junction transistors (BJTs) controlled by applying appropriate base voltages. In an alternative embodiment, the switching elements 90-112 are implemented using field-effect transistors (FETs). In another alternative embodiment, the switching elements 90-112 are implemented using a combination of BJTs and FETs. During operation, the switching elements 90, 92, 94, 96, 98, 100, 102, 104, 106, 108, 110 and 112 are controllable to be placed in an open operational state or a closed operational state via application of an appropriate control voltage or control signal, on the control lines 42, 44, 46, 48, 50, 51, 52, 53, 54, 56, 58 and 60, respectively. Thus, during operation, the configurable 3-D antenna grid 20 can implement a wide variety of different 3-D or 2-D antenna configurations, including hut not limited to loops, dipoles, and stubs for example.

The switch controller 30 is provided to generate control signals to the switching elements 90-112 to open or close the switching elements 90-112 to implement particular antenna configurations. The switch controller 30 is operably coupled to the switching elements 90, 92, 94, 96, 98, 100, 102, 104, 106, 108, 110 and 112 via the control lines 42, 44, 46, 48, 50, 51, 52, 53, 54, 56, 58 and 60. The switch controller 30 operably communicates with the processor 24 and the memory device 28 via the communication buses 36, 38, respectively.

The memory device 28 is provided to store a plurality of antenna configurations or switching element states. In one exemplary embodiment, each switching element may be represented by a bit having a value of "1" if the switching element is to nave an open operational state or a value of "0" if the switching element is to have a closed operational slate in a particular antenna configuration. Accordingly, each antenna configuration is stored as a binary word having a number of bits equal to a number of switching elements in the configurable 3-D antenna grid 20. It should be noted that additional information can be stored in the memory device 28 and associated with each antenna configuration including antenna position information, a time of day, a date, and operational performance characteristics. The exemplary 3-D antenna grid 20 includes twelve switching elements. Therefore, in such an embodiment, each antenna configuration would be represented as a 12-bit binary word. Further, in an alternative embodiment, a single bit can represent groups of multiple switching elements. The memory device 28 operably communicates with the switch controller 30 and the processor 24.

The processor 24 is provided to select an antenna configuration in the configurable 3-D antenna grid 20 based on a desired operational state of the communication system 10. In particular, the processor 24 can select an antenna configuration in the 3-D antenna grid 20 based on a type of radiated electromagnetic signal to be received by the RF receiver 22 or the particular frequency or frequency band in which the communication system 10 is operating. During operation, the RF receiver 22 provides a control signal to the processor 24 or the memory device 28 that indicates an operational mode of the configurable 3-D antenna grid 20. For example, the control signal can indicate whether the configurable 3-D antenna grid 20 is to be configured to receive an amplitude modulation (AM) or a frequency modulation (FM) signal; an ultra high frequency (UHF) or a very high frequency (VHF) signal; a remote function access (RFA) signal; a code division multiple access (CDMA) signal, global system for mobile communications (GSM) signal, or other wireless data and voice communication signals; a global positioning system (GPS) signal; or a satellite-based digital audio radio services (SDARS) signal.

During operation, the processor 24 responds to the control signal from the RF receiver 22 by initiating a search process of possible antenna configurations to select an appropriate antenna configuration for the configurable 3-D antenna grid 20. Rather than beginning at a randomly selected antenna configuration each time the search process is initiated, the processor 24 starts the search process at an antenna configuration that is known to have produced operational and 10 characteristics under the prevailing operating conditions at some point during the usage history of the communication system 10. For example, the processor 24 can address the memory device 28 to retrieve a default antenna configuration for a given operating frequency. If the default antenna configuration produces acceptable operational characteristics, the processor 24 utilizes the default antenna configuration. Alternately, if the default antenna configuration no longer produces acceptable operational characteristics, the processor 24 searches for a new antenna configuration using the default antenna configuration as a starting point. Once the processor 24 finds a new antenna configuration which provides acceptable operational characteristics, the processor 24 updates the memory device 28 via the communication bus 38 to replace the default antenna configuration with the new antenna configuration.

Further during operation, the processor 24 sends data indicating the selected antenna configuration to the switch controller 30 via the communication bus 36. In response to the data, the switch controller 30 addresses the memory device 28 via the communication bus 40 to access a binary word stored in the memory device 28 that corresponds to the selected antenna configuration. The switch controller 30 receives the binary word via the communication bus 40 and, based on the binary word, outputs appropriate switch control signals to the switching elements 90, 92, 94, 96, 98, 100, 102, 104, 106, 108, 110 and 112 via the control lines 42, 44, 46, 48, 50, 51, 52, 53, 54, 56, 58 and 60, respectively, to obtain the selected antenna configuration.

Use processor 24 is configured to operably communicate with the ROM device 26. The ROM device 26 is provided to store computer readable instructions, data structures, program modules or other data that is utilized by the processor 24 for implementing the functionality of the processor 24 described herein. The processor 24 operably communicates with the RF receiver 22, the ROM 26, the switch controller 30, and the memory device 28 via the communication buses 32, 34, 36, 38, respectively.

Figure 2:
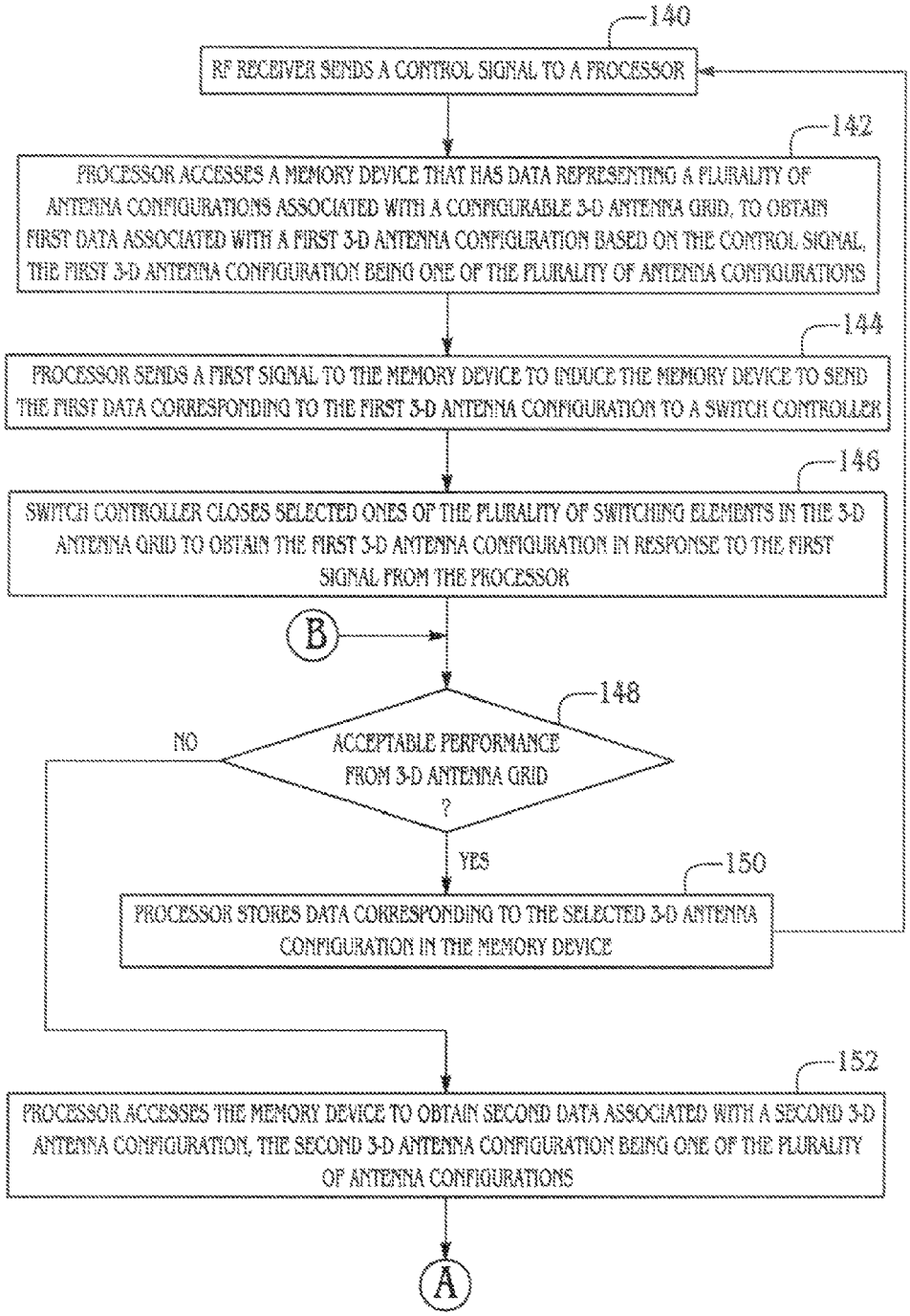
FIGS. 2-3 are flowcharts of a method for configuring the communication system in accordance with another exemplary embodiment.
Figure 3:
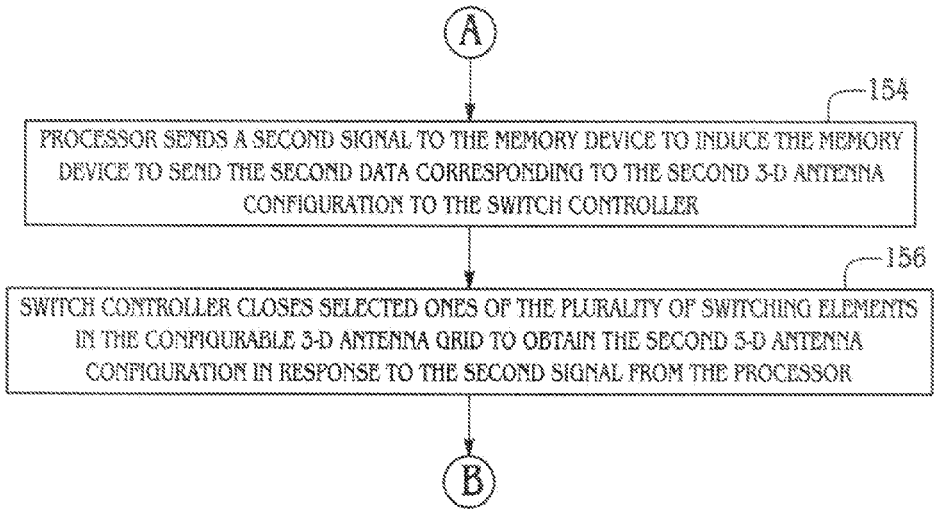

Referring to FIGS. 2-3, a flowchart of a method for configuring the communication system 10 will now be explained. In one exemplary embodiment, the following method is implemented using software algorithms stored in the ROM 26 and executed by the processor 24. It should be noted that although the following method, will be described as obtaining 3-D antenna configurations in a 3-D antenna grid, the method could additionally obtain 2-D antenna configurations in the 3-D antenna grid.

At step 140, the RF receiver 22 sends a control signal to the processor 24.

At step 142, the processor 24 accesses the memory device 28 that has data representing a plurality of antenna configurations associated with a configurable 3-D antenna grid 20, to obtain first data associated with a first 3-D antenna configuration based on the control signal. The first 3-D antenna configuration is one of the plurality of antenna configurations.

At step 144, the processor 24 sends a first signal to the memory device 28 to induce the memory device 28 to send the first data corresponding to the first 3-D antenna configuration to the switch controller 30.

At step 146, the switch controller 30 closes selected ones of the plurality of switching elements in the configurable 3-D antenna grid 20 to obtain the first 3-D antenna configuration in response to the first signal from the processor 24.

At step 148, the processor 24 makes a determination as to whether the configurable 3-D antenna grid 20 has acceptable performance. If the value of step 148 equals "yes", the method advances to step 150. Otherwise, the method advances to step 152.

At step 150, the processor 24 stores first data corresponding to the selected 3-D antenna configuration in the memory device 28. After step 150, the method returns to step 140.

At step 152, the processor 24 accesses the memory device 28 to obtain second data associated with a second 3-D antenna configuration. The second 3-D antenna configuration is one of the plurality of antenna configurations. After step 152, the method advances to step 154.

At step 154, the processor 24 sends a second signal to the memory device 28 to induce the memory device 28 to send the second data corresponding to the second 3-D antenna configuration to the switch controller 30.

At step 156, the switch controller 30 closes selected ones of the plurality of switching elements in the configurable 3-D antenna grid 20 to obtain the second 3-D antenna configuration in response to the second signal from the processor 24. After step 156, the method returns to step 148.

Figure 4:
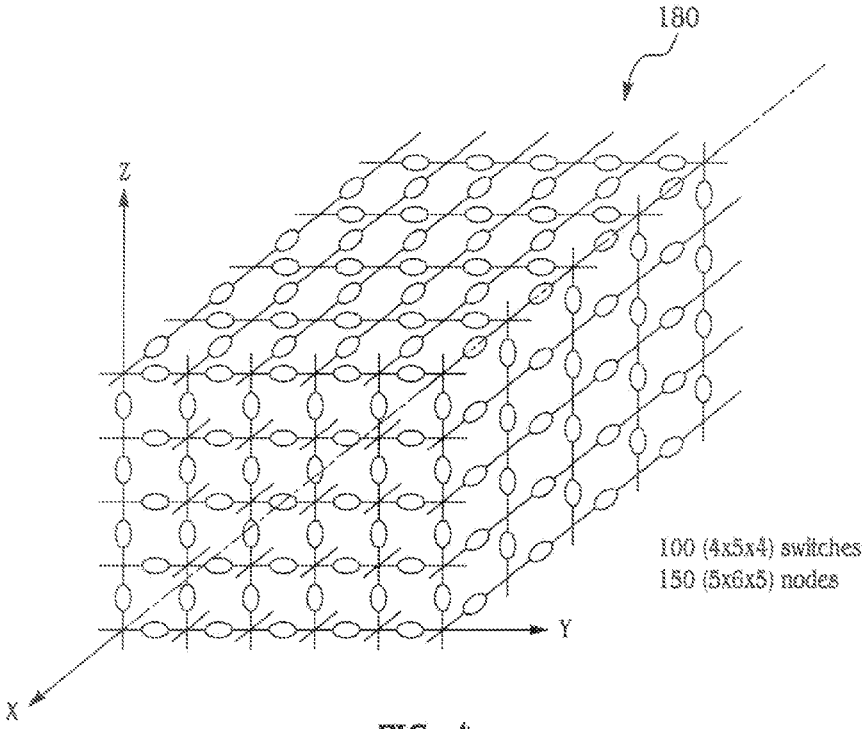
FIG. 4 is a schematic of another exemplary 3-D antenna grid.

Referring to FIG. 4, an alternative configurable 3-D antenna grid 180 that can be utilized in the communication system 10, instead of the configurable 3-D antenna grid 20, is illustrated. The primary difference between the configurable 3-D antenna grid 180 and the configurable 3-D antenna grid 20 is that the configurable 3-D antenna grid 180 has a greater number of switching elements and antenna elements than the configurable 3-D antenna grid 20.

Figure 5:
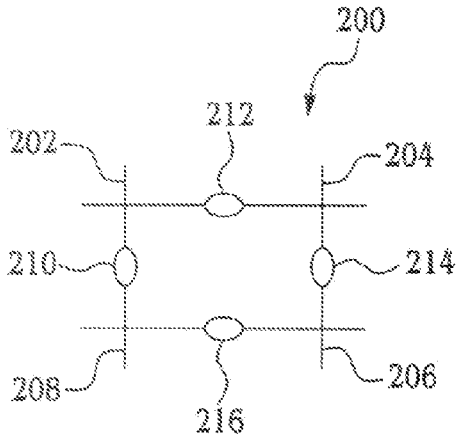
FIG. 5 is a schematic of an exemplary rectangular-shaped antenna portion.

Referring to FIG. 5, a rectangular-shaped antenna portion 200 that can be utilized in an alternative configurable 3-D antenna grid is illustrated. The rectangular-shaped antenna portion 200 includes antenna elements 202, 204, 206, 208 operably coupled to switching elements 210, 212, 214, 216. The alternative configurable 3-D antenna grid can be constructed utilizing a plurality of rectangular-shaped antenna portions 200.

Figure 6:
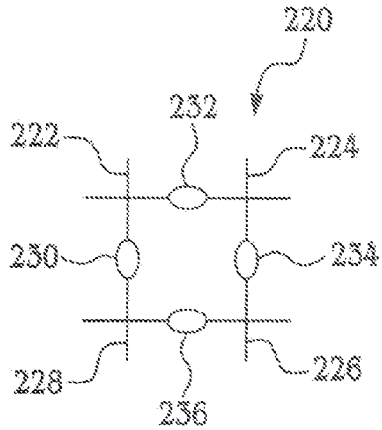
FIG. 6 is a schematic of an exemplary square-shaped antenna portion.

Referring to FIG. 6, a square-shaped antenna portion 220 that can be utilized in an alternative configurable 3-D antenna grid is illustrated. The square-shaped antenna portion 200 includes antenna elements 222, 224, 226, 228 operably coupled to switching elements 230, 232, 234, 236. The alternative configurable 3-D antenna grid can be constructed utilizing a plurality of square-shaped antenna portions 220.

Figure 7:
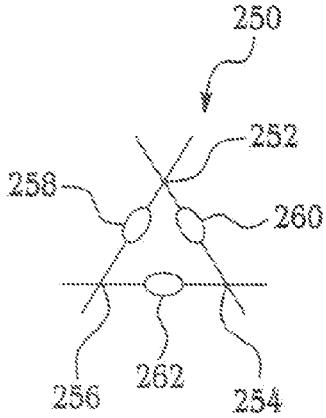
FIG. 7 is a schematic of an exemplary triangular-shaped antenna portion.

Referring to FIG. 7, a triangular-shaped antenna portion 250 that can be utilized in an alternative configurable 3-D antenna grid is illustrated. The triangular-shaped antenna portion 250 includes antenna elements 252, 254, 256 operably coupled to the switching elements 258, 260, 262. The alternative configurable 3-D antenna grid can be constructed utilizing a plurality of triangular-shaped antenna portions 250.

Figure 8:
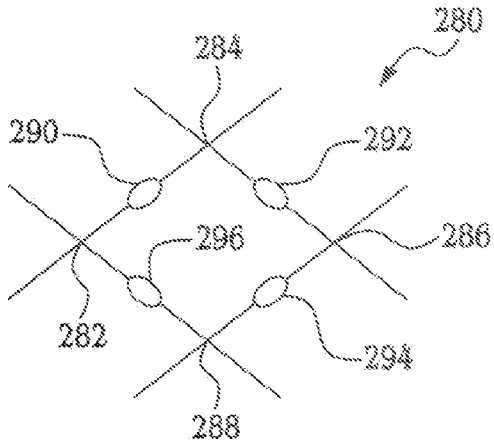
FIG. 8 is a schematic of an exemplary rhombus-shaped antenna portion.

Referring to FIG. 8, a rhombus-shaped antenna portion 280 that can be utilized in an alternative configurable 3-D antenna grid is illustrated. The rhombus-shaped antenna portion 280 includes antenna elements 282, 284, 286, 288 operably coupled to the switching elements 290, 292, 294, 296. The alternative configurable 3-D antenna grid can be constructed utilizing a plurality of rhombus-shaped antenna portions 280.

Figure 9:
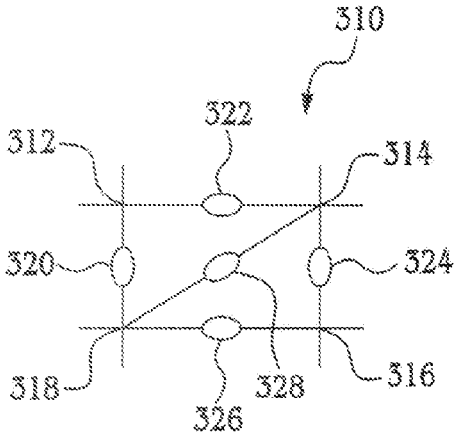
FIG. 9 is a schematic of another exemplary complex antenna portion.

Referring to FIG. 9, a complex-shaped antenna portion 310 that can be utilized in an alternative configurable 3-D antenna grid is illustrated. The complex-shaped antenna portion 310 includes antenna elements 312, 314, 316, 318 operably coupled to the switching elements 320, 322, 324, 326 and 328. The alternative configurable 3-D antenna grid can be constructed utilizing a plurality of complex-shaped antenna portions 310.

Figure 10:
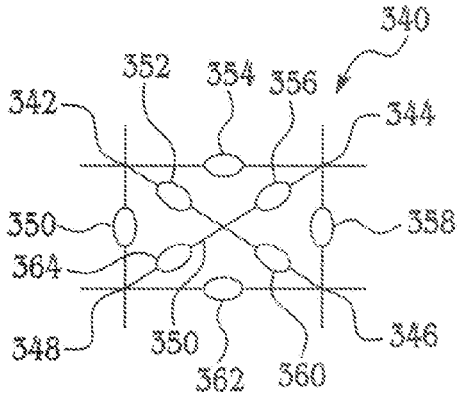
FIG. 10 is a schematic of another exemplary complex antenna portion.
Figure 11:
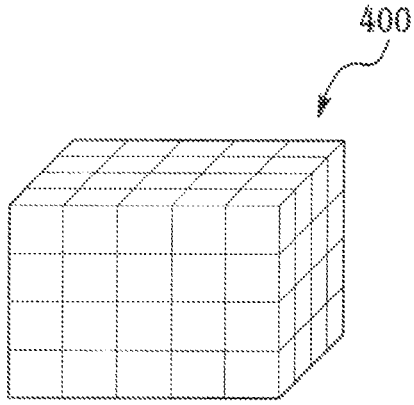
FIG. 11 is a schematic of an exemplary cube-shaped 3-D antenna grid.
Figure 12:
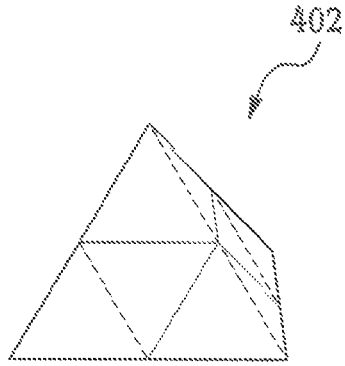
FIG. 12 is a schematic of an exemplary pyramid-shaped 3-D antenna grid.
Figure 13:
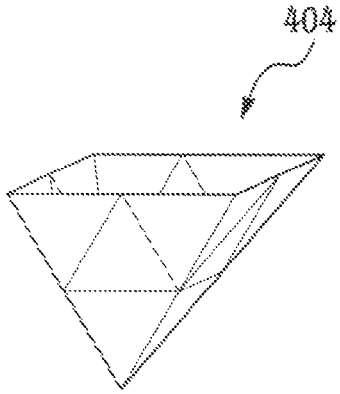
FIG. 13 is a schematic of an exemplary pyramid-shaped 3-D antenna grid.
Figure 14:
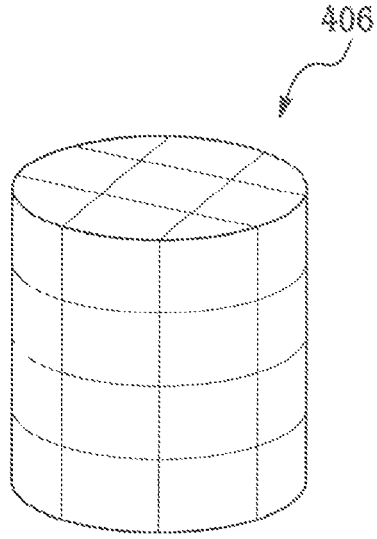
FIG. 14 is a schematic of an exemplary cylindrical-shaped 3-D antenna grid.
Figure 15:
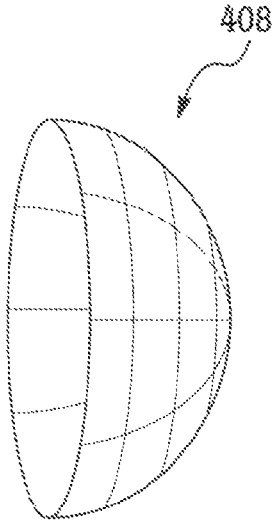
Figure 16:
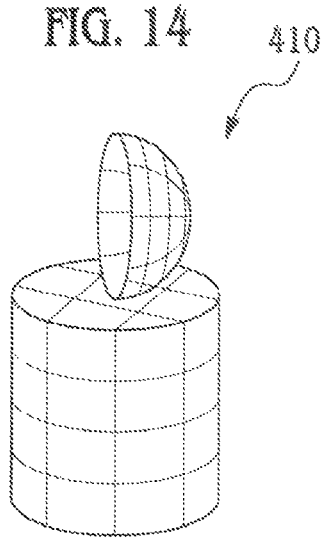
FIG. 16 is a schematic of an exemplary complex-shaped 3-D antenna grid.

Referring to FIG. 10, another complex-shaped antenna portion 340 that can be utilized in an alternative configurable 3-D antenna grid is illustrated. The complex-shaped antenna portion 340 includes antenna elements 342, 344, 346, 348 operably coupled to the switching elements 350, 352, 354, 356, 358, 360, 362, 364. The alternative configurable 3-D antenna grid can be constructed utilizing a plurality of complex-shaped antenna portions 340.

It should be noted that a configurable 3-D antenna grid can have a shape determined by the desired operational characteristics of the 3-D antenna grid. Referring to FIGS. 11-16, 3-D antenna grids are illustrated having exemplary shapes For example, referring to FIG. 11, a configurable 3-D antenna grid 400 is illustrated. The configurable 3-D antenna grid 400 has a closed-cube shape with six external surfaces. Farther, for example, referring to FIG. 12, a configurable 3-D antenna grid 402 is illustrated. The configurable 3-D antenna grid 402 has a closed-pyramid shape with four external surfaces. Further, for example, referring to FIG. 13, a configurable 3-D antenna grid 404 is illustrated. The configurable 3-D antenna grid 404 has an open-pyramid shape with four external surfaces. Further, for example, referring to FIG. 14, a configurable 3-D antenna grid 406 is illustrated. The configurable 3-D antenna grid 406 has a closed-cylindrical shape with three external surfaces. Further, for example, referring to FIG. 15, a configurable 3-D antenna grid 408 is illustrated. The configurable 3-D antenna grid 408 has a cone-shape. Further, for example, referring to FIG. 16, a configurable 3-D antenna grid 410 is illustrated. The configurable 3-D antenna grid 410 has a cylindrically-shaped portion coupled to a cone shaped portion.

The communication system having a configurable 3-D antenna grid represents a substantial improvement over other systems and antennas. In particular, the communication system provides a technical effect of utilizing a configurable 3-D antenna grid to modify its antenna configuration to receive wireless signals at a predetermined acceptable performance level.

While the invention has been described with reference to exemplary embodiments, it will be understood by those skilled in the art that various changes may be made and equivalent elements may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another. Further, the use of the terms a, an, etc. do not denote a limitation of quantity, but rather denote the presence of at least one of the referenced item.

What is claimed is:

1. An antenna system, comprising:

a plurality of discrete antenna elements spaced apart from one another and fixedly arranged to form a three-dimensional antenna grid;

a plurality of switching elements, each switching element configured to selectively electrically interconnect and disconnect an associated pair of said antenna elements, whereby all of said antenna elements are selectively connectable by combinations of said switching elements; and a switch controller coupled to each of the plurality of switching elements, said switch controller operable to close selected ones of the plurality of switching elements to establish a first three-dimensional antenna configuration within the antenna grid having a first predetermined geometric configuration, and to close other selected ones of the plurality of switching elements to establish a second three-dimensional antenna configuration within the antenna grid having a second predetermined geometric configuration.

2. The antenna system of claim 1, further comprising a memory device operably coupled to the switch controller, the memory device configured to store data representing a plurality of antenna configurations, the first 3-D antenna configuration being one of the plurality of antenna configurations.

3. The antenna system of claim 1, wherein the switch controller is further configured to close selected ones of the plurality of switching elements to obtain a two-dimensional antenna configuration in the configurable three-dimensional antenna grid, the two-dimensional antenna configuration having at least a portion of the plurality of antenna elements electrically coupled together.

4. The antenna system of claim 1, wherein the switch controller is configured to close the selected ones of the plurality of switching elements in the configurable three-dimensional antenna grid, based on desired antenna operational characteristics.

5. A communication system, comprising:

an antenna system having a plurality of discrete antenna elements spaced apart from one another and fixedly arranged to form a three-dimensional antenna grid, a plurality of switching elements, each switching element configured to selectively electrically interconnect and disconnect an associated pair of said antenna elements, whereby all of said antenna elements are selectively connectable by combinations of said switching elements, and a switch controller coupled to each of the plurality of switching elements, said switch controller operable to close selected ones of the plurality of switching elements to establish a first three-dimensional antenna configuration within the antenna grid having a first predetermined geometric configuration, and to close other selected ones of the plurality of switching elements to establish a second three-dimensional antenna configuration within the antenna grid having a second predetermined geometric configuration; and a memory device operably coupled to the switch controller, the memory device configured to store data representing a plurality of antenna configurations;

a processor operably communicating with the switch controller and the memory device, the processor configured to generate a signal to induce the memory device to send first data corresponding to a first three-dimensional antenna configuration to the switch controller, wherein the switch controller configured to close selected ones of the plurality of switching elements to obtain the first three-dimensional antenna configuration in the configurable three-dimensional antenna grid in response to the first data, the first three-dimensional antenna configuration being one of the plurality of antenna configurations wherein at least a portion of the plurality of antenna elements are electrically coupled together.

6. The communication system of claim 5, wherein the switch controller is further configured to close selected ones of the plurality of switching elements to obtain a two-dimensional antenna configuration in the configurable three-dimensional antenna grid, the two-dimensional antenna configuration having at least a portion of the plurality of antenna elements electrically coupled together.

7. The communication system of claim 5, wherein the switch controller is configured to close the selected ones of the plurality of switching elements in the configurable three-dimensional antenna grid, based on desired antenna operational characteristics.

8. A method for configuring a communication system, the communication system having an antenna system with a plurality of discrete antenna elements spaced apart from one another and fixedly arranged to form a three-dimensional antenna grid and a plurality of switching elements, each switching element configured to selectively electrically interconnect and disconnect an associated pair of said antenna elements, said method comprising the steps of:

selecting a first three-dimensional antenna configuration associated with the configurable three-dimensional antenna grid from a plurality of antenna configurations;

controlling a memory device to output first data corresponding to the first three-dimensional antenna configuration; and closing selected ones of the plurality of switching elements to obtain the first three-dimensional antenna configuration in the configurable three-dimensional antenna grid in response to the first data, the first three-dimensional antenna configuration being one of the plurality of antenna configurations wherein at least a portion of the plurality of antenna elements are electrically coupled together.

9. The method of claim 8, further comprising:

selecting a two-dimensional antenna configuration associated with the configurable three-dimensional antenna grid from the plurality of antenna configurations;

controlling the memory device to output second data corresponding to the two-dimensional antenna configuration; and closing selected ones of the plurality of switching elements to obtain the two-dimensional antenna configuration in the configurable three-dimensional antenna grid in response to the second data, the two-dimensional antenna configuration being one of the plurality of antenna configurations wherein at least a portion of the plurality of antenna elements are electrically coupled together.

* * * * *